US011732573B2

(12) United States Patent
Nam et al.

(10) Patent No.: US 11,732,573 B2
(45) Date of Patent: Aug. 22, 2023

(54) METHOD FOR OPTIMIZING A DESIGN OF ARTIFICIAL RECHARGE

(71) Applicant: Dong-A University Research Foundation for Industry-Academy Cooperation, Busan (KR)

(72) Inventors: Byunghee Nam, Busan (KR); Namsik Park, Busan (KR); Roshina Babu, Incheon (KR)

(73) Assignee: DONG-A UNIVERSITY RESEARCH FOUNDATION FOR INDUSTRY-ACADEMY COOPERATION, Busan (KR)

( * ) Notice: Subject to any disclaimer, the term of this patent is extended or adjusted under 35 U.S.C. 154(b) by 228 days.

(21) Appl. No.: 17/140,142

(22) Filed: Jan. 4, 2021

(65) Prior Publication Data

US 2022/0213782 A1 Jul. 7, 2022

(51) Int. Cl.

| | |
|---|---|
| ***E21B 47/06*** | (2012.01) |
| ***E03B 3/08*** | (2006.01) |
| ***E21B 47/09*** | (2012.01) |

(52) U.S. Cl.

CPC ..... *E21B 47/06* (2013.01); *E03B 3/08* (2013.01); *E21B 47/09* (2013.01)

(58) Field of Classification Search

CPC ..... E21B 47/06; E21B 47/09; E03B 3/08

See application file for complete search history.

(56) References Cited

U.S. PATENT DOCUMENTS

| | | | | |
|---|---|---|---|---|
| 4,254,831 A * | 3/1981 | Nuzman | ..... | E21B 43/30 166/252.1 |
| RE40,734 E * | 6/2009 | Borden | ..... | B09C 1/00 166/305.1 |
| 9,011,689 B1 * | 4/2015 | Czarnecki | ..... | C02F 3/32 210/170.03 |
| 10,533,296 B2 | 1/2020 | Park et al. | | |

(Continued)

FOREIGN PATENT DOCUMENTS

| | | | | |
|---|---|---|---|---|
| CN | 211421243 U * | 9/2020 | ..... | E03B 3/34 |
| KR | 1020110072559 A | 6/2011 | | |

(Continued)

OTHER PUBLICATIONS

Rubiandini et al. "Designing an Injection Program of Produced Water Re-Injection in Mature Fields," SPE-77837 (Year: 2002).*

(Continued)

*Primary Examiner* — John Fitzgerald

(74) *Attorney, Agent, or Firm* — Cantor Colburn LLP

(57) ABSTRACT

There is provided a method for determining an optimal condition for artificial recharge by using a computer in an artificial recharge system provided with an injection well for injecting fresh water into an aquifer, the method including: a step of calculating a maximum permissible quantity of injection of fresh water to be injected into the aquifer; a step of determining a height of a screen which is an area on a side surface of the injection well where penetrating holes are formed, based on the calculated maximum permissible quantity of injection; and a step of determining an injection pressure of the fresh water to be injected into the aquifer, based on the height of the screen.

7 Claims, 5 Drawing Sheets

(56) References Cited

U.S. PATENT DOCUMENTS

| | | | | |
|---|---|---|---|---|
| 2005/0186030 | A1* | 8/2005 | Peters | E03B 3/36 405/52 |
| 2012/0261125 | A1* | 10/2012 | Divine | B09C 1/08 166/279 |
| 2015/0039234 | A1* | 2/2015 | Abou-Sayed | G01V 99/00 702/11 |
| 2015/0294050 | A1* | 10/2015 | Chmakov | E21B 47/00 703/2 |
| 2016/0025894 | A1* | 1/2016 | Abou-Sayed | G01V 99/00 703/2 |

FOREIGN PATENT DOCUMENTS

| | | | | |
|---|---|---|---|---|
| KR | 1020120057461 | A | 6/2012 | |
| KR | 10-1706280 | B1 | 2/2017 | |
| KR | 10-1818925 | B1 | 1/2018 | |
| KR | 101833961 | B1 * | 3/2018 | E03B 3/34 |

OTHER PUBLICATIONS

McDonald et al. "A Modular Three-Dimensional Finite-Difference Ground-Water Flow Model," US Geological Survey Report 83-875 (Year: 1984).*

English Machine Translation of KR 10-1706280 (Year: 2017).*

English Machine Translation of KR 10-1818925 (Year: 2018).*

Korean Office Action for KR Application No. 10-2021-0000374 dated May 24, 20202.

* cited by examiner

METHOD FOR OPTIMIZING A DESIGN OF ARTIFICIAL RECHARGE

TECHNICAL FIELD

The present disclosure relates to artificial recharge, and more particularly, to a method for optimizing a design of artificial recharge to determine a configuration of an injection well for injecting fresh water into a confined aquifer, and an injection pressure and a quantity of injection as optimal conditions.

BACKGROUND ART

If an aquifer is developed under an aquiclude like an impermeable layer, groundwater in the aquifer does not have a free water level and goes into a confined state. Such an aquifer is called a confined aquifer. Since the confined aquifer can hold water (fresh water), the confined aquifer stores water during a rainy season and water is pumped and used during a dry season. Technology for injecting or pumping water into or from the confined aquifer for various purposes is referred to as artificial recharge technology.

An economical method to maximize the effect of artificial recharge may be burying as few wells as possible and injecting as much water as possible through wells. However, if much water is injected into one well, a crack may occur in the aquiclude overlying the confined aquifer due to water pressure, and water may gush from the surface of the earth and may be lost.

Accordingly, artificial recharge should be performed by burying an appropriate number of wells and injecting an appropriate amount of fresh water according to a region where the artificial recharge is to be performed, and currently, a configuration of such a well or an amount of injection and an injection pressure are mostly determined based on experiences.

CITED REFERENCES

Patent Document 1: Korean Patent Laid-Open Publication No. 10-2011-0072559 (published on Jun. 29, 2011)

Patent Document 2: Korean Patent Laid-Open Publication No. 10-2012-0057461 (published on Jun. 5, 2012)

DETAILED DESCRIPTION OF THE INVENTION

Objects to be Solved

In the related-art method as described above, a design of an injection well, an amount of injection, and an injection pressure are set based on experiences, and artificial recharge is performed. In this case, however, a crack may occur and artificial recharge may fail, or a smaller amount of fresh water than an amount of fresh water that can really be injected may be injected and, as a result, artificial recharge may be inefficiently performed.

The present disclosure has been developed in order to solve the above-mentioned problems, and an object of the present disclosure is to provide a method for optimizing artificial recharge, which can perform artificial recharge under an optimal condition by determining a structure (screen height) of an injection well based on characteristics of an aquiclude and a confined aquifer of a region where the injection well is to be buried, calculating a maximum permissible injection pressure and a maximum permissible quantity of injection according to the structure of the injection well, and then burying the injection well and injecting fresh water.

Means for Solving the Problem

According to an embodiment of the present disclosure, a method for designing an optimal condition for artificial recharge by using a computer in an artificial recharge system provided with an injection well for injecting fresh water into an aquifer includes: a step of calculating a maximum permissible quantity of injection Q1 of fresh water to be injected into the aquifer; a step of determining a height L1 of a screen which is an area on a side surface of the injection well where penetrating holes are formed, based on the calculated maximum permissible quantity of injection Q1; and a step of determining an injection pressure P1 of the fresh water to be injected into the aquifer, based on the height L1 of the screen.

In an embodiment, the step of calculating the maximum permissible quantity of injection (Q1) may include: a step of calculating a permissible injection pressure $P_{i,Max}$ according to a certain screen height Ls; a step of calculating a quantity of injection Qi according to the certain screen height Ls, and a step of calculating a permissible quantity of injection $Q_{i,Max}$ according to the certain screen height Ls, based on a relationship between the calculated permissible injection pressure and the calculated quantity of injection.

In an embodiment, the step of determining the height L1 of the screen may include determining, as the maximum permissible quantity of injection Q1, a permissible quantity of injection having a maximum value in the relationship of the permissible quantity of injection $Q_{i,Max}$ according to the certain screen height Ls, and determining a screen height at this time as the height L1 of the screen.

In an embodiment, the step of determining the injection pressure P1 may include determining, as the injection pressure P1, a permissible injection pressure corresponding to the height L1 of the screen in the relationship of the permissible injection pressure $P_{i,Max}$ according to the certain screen height Ls.

According to an embodiment of the present disclosure, there is provided a computer-readable recording medium having a program recorded thereon to execute the artificial recharge optimization method described above in a computer.

Effects of the Invention

According to an embodiment, artificial recharge can be performed in a corresponding region under optimal conditions by determining a structure (screen height) of an injection well based on characteristics of an aquiclude and a confined aquifer of the region where the injection well is to be buried, calculating a maximum permissible injection pressure and a maximum permissible quantity of injection according to the structure of the injection well, and then burying the injection well and injecting fresh water, and thus efficiency of artificial recharge can be maximized.

DETAILED DESCRIPTION OF EXEMPLARY EMBODIMENTS

Figure 1:
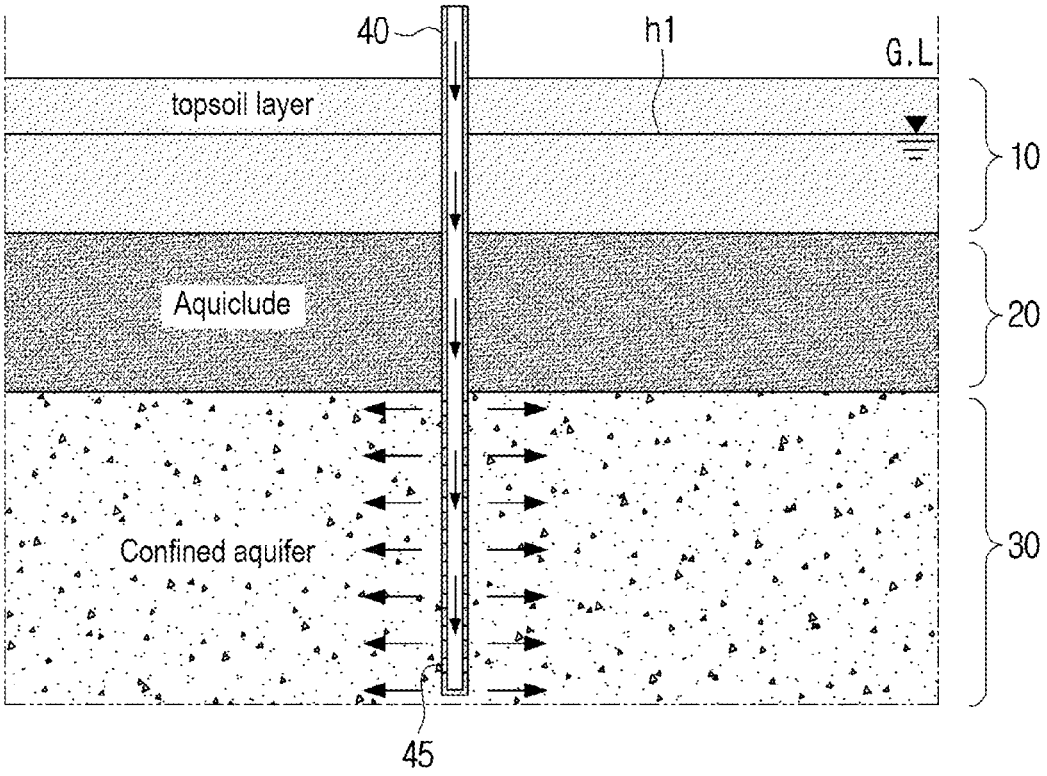
FIG. 1 is a view to explain normal structures of ground layers for artificial recharge.

Exemplary embodiments will now be described more fully with reference to the accompanying drawings to clarify objects, other objects, features and advantages of the present disclosure. The exemplary embodiments may, however, be embodied in many different forms and should not be construed as limited to the exemplary embodiments set forth herein. Rather, the exemplary embodiments are provided so that this disclosure will be thorough and complete, and will fully convey the scope of the application to those of ordinary skill in the art.

In the drawings, dimensions of elements such as length, thickness, width may be exaggerated for effective explanation of technical features.

In the detailed descriptions of the present disclosure, the singular forms "a," "an" and "the" are intended to include the plural forms as well, unless the context clearly indicates otherwise. It will be further understood that the terms "include," "configured with" and "comprise." when used in this specification, do not preclude the presence or addition of one or more other components.

Hereinafter, exemplary embodiments will be described in greater detail with reference to the accompanying drawings. The matters defined in the description, such as detailed construction and elements, are provided to assist in a comprehensive understanding of the exemplary embodiments. However, it is apparent that the exemplary embodiments can be carried out by those of ordinary skill in the art without those specifically defined matters. In the description of the exemplary embodiment, certain detailed explanations of related art are omitted when it is deemed that they may unnecessarily obscure the essence of the inventive concept.

FIG. 1 schematically illustrates normal structures of ground layers for artificial recharge. Referring to FIG. 1, a topsoil layer 10, an aquiclude 20, and a confined aquifer 30 are formed from the surface of the earth to the bottom. The topsoil layer 10 is a layer that has a thickness of tens of centimeters to tens of meters from the surface of the earth. The aquiclude is a ground layer that has a void formed of minute soil and has a very low permeability coefficient. Typically, the aquiclude 20 is formed of certain soil components having a low permeability coefficient such as clay, silt, or a hardpan layer. Hereinafter, the aquiclude may be referred to as an "impermeable layer" for convenience of explanation.

The confined aquifer is an aquifer that is surrounded by the aquiclude or the impermeable layer on an upper portion and a lower portion, and is formed of soil components having a high permeability coefficient. Although FIG. 1 illustrates only sand and gravel as components of the confined aquifer 30, the confined aquifer may be typically formed of various rock constituents such as sand, gravel, sandstone, alluvial layer, cavernous limestone, cracked marble, cracked granite, clastic quartzite, etc.

Since the confined aquifer 30 (hereinafter, simply referred to as an "aquifer") is under pressure from the upper ground layer, a groundwater table in a well inserted into the aquifer 30 is formed higher than an upper boundary of the aquifer. That is, if a well is buried down to the aquifer 30, a groundwater table (hereinafter, referred to as a "water head") of the aquifer 30 has a virtual water table indicated by hi as shown in FIG. 1.

In an embodiment of the present disclosure, an artificial recharge system includes an injection well 40 to inject fresh water into the aquifer 30. Elements for injecting fresh water through the injection well 40, such as a pump, a controller, etc., may be omitted for convenience of explanation.

A screen 45 having a plurality of penetrating holes formed thereon is formed on a surface of a lower area of the injection well 40. The screen 45 may be formed to a predetermined height from a lower end of the injection well 40, and artificial recharge may be performed by injecting fresh water supplied to the injection well 40 from the outside into the aquifer 30 through the penetrating holes of the screen 45.

Figure 2:
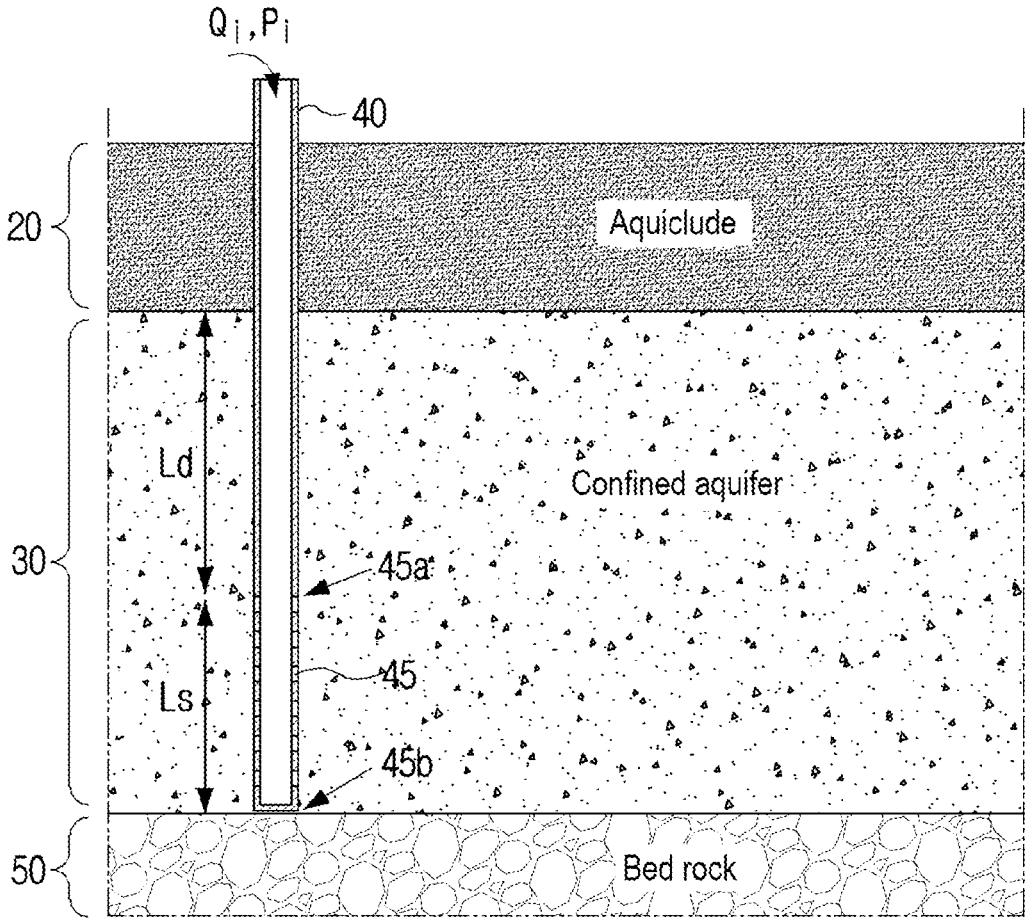
FIG. 2 is a view to explain an injection well for injecting fresh water into a confined aquifer according to an embodiment.

Referring to FIG. 2, the injection well 40 according to an embodiment will be described in detail. In FIG. 2, it is assumed that the injection well 40 is buried down to a lowermost portion of the confined aquifer 30. That is, in the illustrated embodiment, the injection well 40 is buried close to an interface between the aquifer 30 and underlying bed rock 50.

The screen 45 of a predetermined height Ls is formed on a lower area of the injection well 40. A height (length) from a lowermost portion 45*b* of the screen 45 to an uppermost portion 45*a* is indicated by "Ls", and a distance from the screen uppermost portion 45*a* to the upper layer portion of the aquifer 30, that is, to an interface between the aquifer 30 and the aquiclude 20, is indicated by "Ld".

Figure 3A:
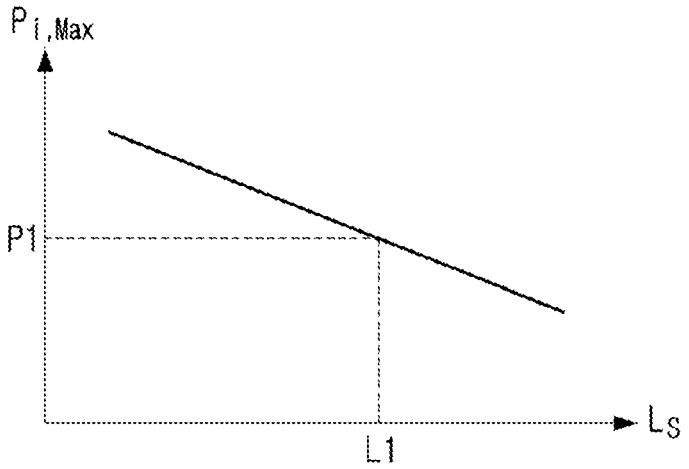
FIGS. 3A, 3B, and 3C are graphs schematically illustrating relationship of a permissible injection pressure, a quantity of injection, and a permissible quantity of injection of a confined aquifer according to a screen height of an injection well.
Figure 3B:
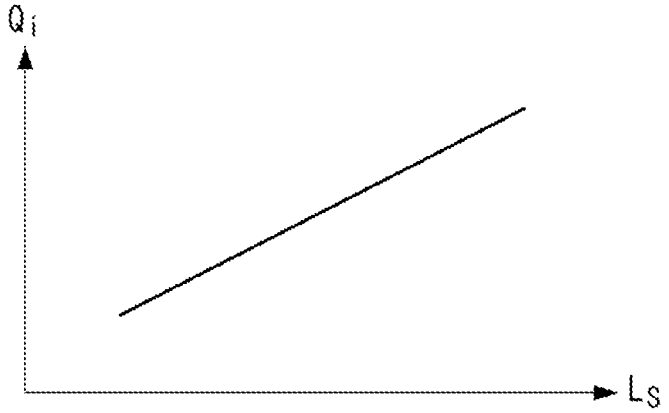
Figure 3C:
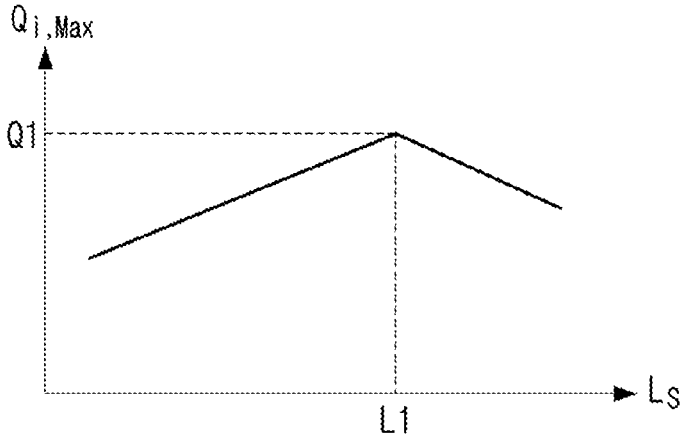

The artificial recharge system according to an embodiment of the present disclosure determines the screen height Ls of the injection well 40 and an injection pressure Pi which are optimized to increase a permissible quantity of injection ($Q_{i,Max}$) under a pressure rising condition of a range in which a crack does not occur in the aquiclude. As shown in FIGS. 3A to 3C, to optimize a design of artificial recharge in the present disclosure, the relationship of a permissible injection pressure Pi and a quantity of injection $Q_i$ of the injection well 40 according to the screen height Ls of the injection well 40 may be derived, and based on this relationship, the relationship of a permissible quantity of injection $Q_{i,Max}$ according to the screen height Ls may be calculated, and then, an optimal screen height Ls, and a quantity of fresh water injection and an injection pressure corresponding thereto may be derived.

Referring FIG. 3A, the injection well 40 is installed in the aquifer 30 and fresh water is injected into the aquifer 30. As the screen height Ls is higher, the permissible injection pressure $P_{i,Max}$ is lower. Herein, the "permissible injection pressure' $P_{i,Max}$ refers to a maximum permissible pressure of fresh water to be injected through the injection well 40.

It is common that a pressure causing a crack in the aquiclude 20 is determined by a depth and characteristics of the ground layer. On the other hand, the pressure exerted to the aquifer 30 when fresh water is injected into the aquifer 30 under a predetermined injection pressure dissipates and is lower toward the top of the aquifer 30. In this regard, FIGS. 4A to 4C are views to explain a change in the injection pressure according to a depth of the confined aquifer 30.

Figures 4A, 4B, 4C:
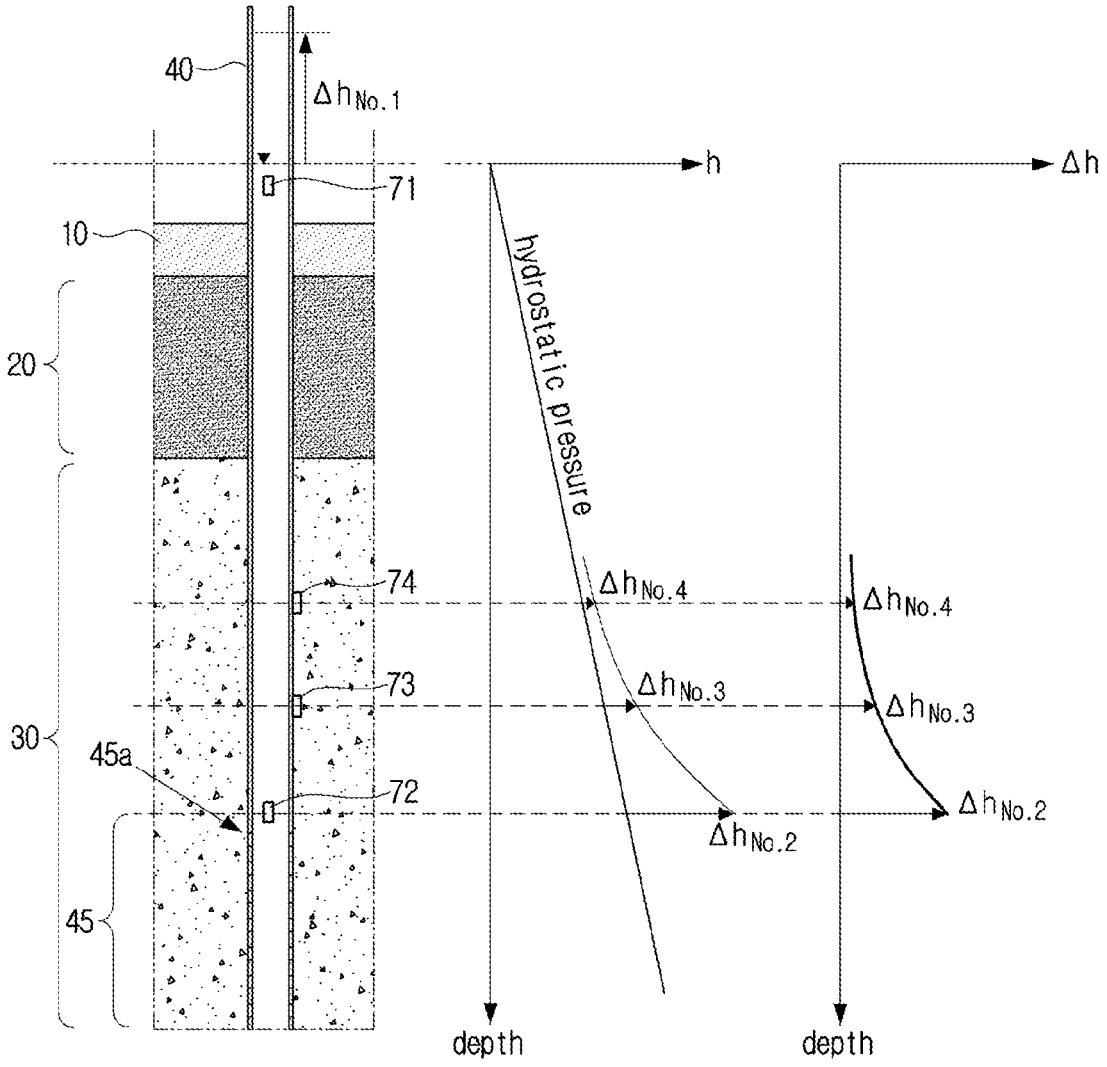
FIGS. 4A, 4B and 4C are views to explain a change in injection pressure according to a depth of a confined aquifer.

FIG. 4A illustrates structures of ground layers which are formed of a topsoil layer 10, an aquiclude 20, and an aquifer 30, and are the same as FIG. 1 or 2. The vertical axis of the graphs of FIGS. 4B and 4C indicates a depth from the surface of the earth in the structures of the ground layers of FIG. 4A, and the horizontal axes indicate a hydrostatic pressure h at each depth and a change in the hydrostatic pressure Δh according to injection of fresh water, respectively.

As shown in FIG. 4A, the injection well 40 is buried in the aquifer 30 and a screen 45 of a predetermined height is formed on a lower portion of the injection well 40. In this case, first to fourth pressure sensors 71 to 74 are installed to measure a hydrostatic pressure according to a fresh water injection pressure. The first sensor 71 is installed at a water head height, the second sensor 72 is installed at an uppermost end 45*a* of the screen 45, and the third sensor 73 and the fourth sensor 74 are installed above the second sensor 72 at predetermined intervals in the aquifer 30.

It is assumed that fresh water is injected through the injection well 40 under a predetermined pressure in this configuration. In this case, the second sensor 72 detects the same pressure increase ($\Delta h_{NO.2}$) as the predetermined pressure. However, since the fresh water injected into the aquifer 30 gradually dissipates in the aquifer 30, the detected injection pressure decreases toward the top. That is, the third sensor 73 and the fourth sensor 74 detects pressure increase of $\Delta h_{NO.3}$ and $\Delta h_{NO.4}$ respectively, and the pressure increase is gradually reduced toward the top. Therefore, it will be understood that, w % ben fresh water is injected under a specific injection pressure, a pressure lower than the specific injection pressure is applied to an aquiclude-aquifer interface and an aquiclude area overlying the interface.

In addition, according to the above-described principle, if the injection pressure is set to a specific constant pressure, but the screen height Ls is differently set, a pressure exerted to the aquiclude-aquifer interface increases as the screen height Ls is higher (that is, as the uppermost end 45*a* of the screen is higher). That is, if the screen height Ls is high, the specific injection pressure is applied at as a high position as the screen height in the aquifer 30 and the pressure is lower toward the top. If the screen height Ls is low, the specific injection pressure is applied at as a low position as the screen height in the aquifer 30 and the pressure is lower toward the top. Accordingly, it can be understood that, as the screen height Ls is higher, the pressure exerted to the aquiclude-aquifer interface increases. In this case, when the pressure exerted to the aquiclude-aquifer interface is greater than or equal to a predetermined threshold value, a crack may occur in the aquiclude due to water pressure and groundwater may gush. Therefore, the pressure exerted to the aquiclude-aquifer interface should not exceed the threshold value.

As a result, since as the screen height Ls is higher, the pressure exerted to the aquiclude-aquifer interface increases, an injection pressure of the injection well 40 should be set to a low pressure, and, as shown in FIG. 3A, the screen height Ls and the permissible injection pressure $P_{i,Max}$ are inversely proportional each other. To apply as a high injection pressure as possible to inject more fresh water, the screen height Ls should be lowered.

Referring to FIG. 3B, the screen height Ls and the quantity of injection Qi of fresh water to be injected into the aquifer 30 are directly proportional to each other. On the assumption that injection pressure is constant, as the screen height Ls is higher, more water may be injected into the aquifer 30 through the injection well 40 since the screen 40 has more penetrating holes. On the other hand, when the screen height Ls is lower, the quantity of injection is reduced since the number of penetrating holes of the screen 40 is smaller. Therefore, according to the relationship of FIG. 3B, on the assumption that the injection pressure is constant, the screen height Ls should be raised to inject as much fresh water as possible, and, as the screen height Ls is lower, much fresh water may not be injected.

Accordingly, considering FIG. 3A and FIG. 3B, simultaneously, as the screen height Ls is higher, much fresh water can be injected into the aquifer 30, but should be injected under a low injection pressure, and, as the screen height Ls is lower, fresh water may be injected under a high injection pressure, but the quantity of injection may be reduced. Therefore, if FIG. 3A and FIG. 3B are considered simultaneously, that is, if the assumption that the injection pressure is constant in FIG. 3B is applied to a change in the injection pressure according to the screen height Ls, which is determined in FIG. 3A, a relationship equation of a permissible quantity of injection $Q_{i,Max}$ of fresh water that can be substantially injected according to the screen height Ls may be obtained as shown in FIG. 3C. That is, considering the permissible injection pressure $P_{i,Max}$ and the quantity of injection Qi according to the screen height Ls, the permissible quantity of injection $Q_{i,Max}$ may increase as the screen height Ls increases up to a predetermined height (that is, L1 in FIG. 3C), but, when the screen height Ls increases beyond the height, the permissible quantity of injection $Q_{i,Max}$ may be reduced.

Therefore, the screen height L1 when the permissible quantity of injection ($Q_{i,Max}$) reaches a maximum is determined as an optimal screen height, and a permissible quantity of injection Q1 and a permissible injection pressure P1 when the screen 40 is L1 high are calculated, respectively.

Hereinafter, an exemplary method for designing an optimal artificial recharge condition in the above-described method will be described with reference to FIG. 5.

Figure 5:
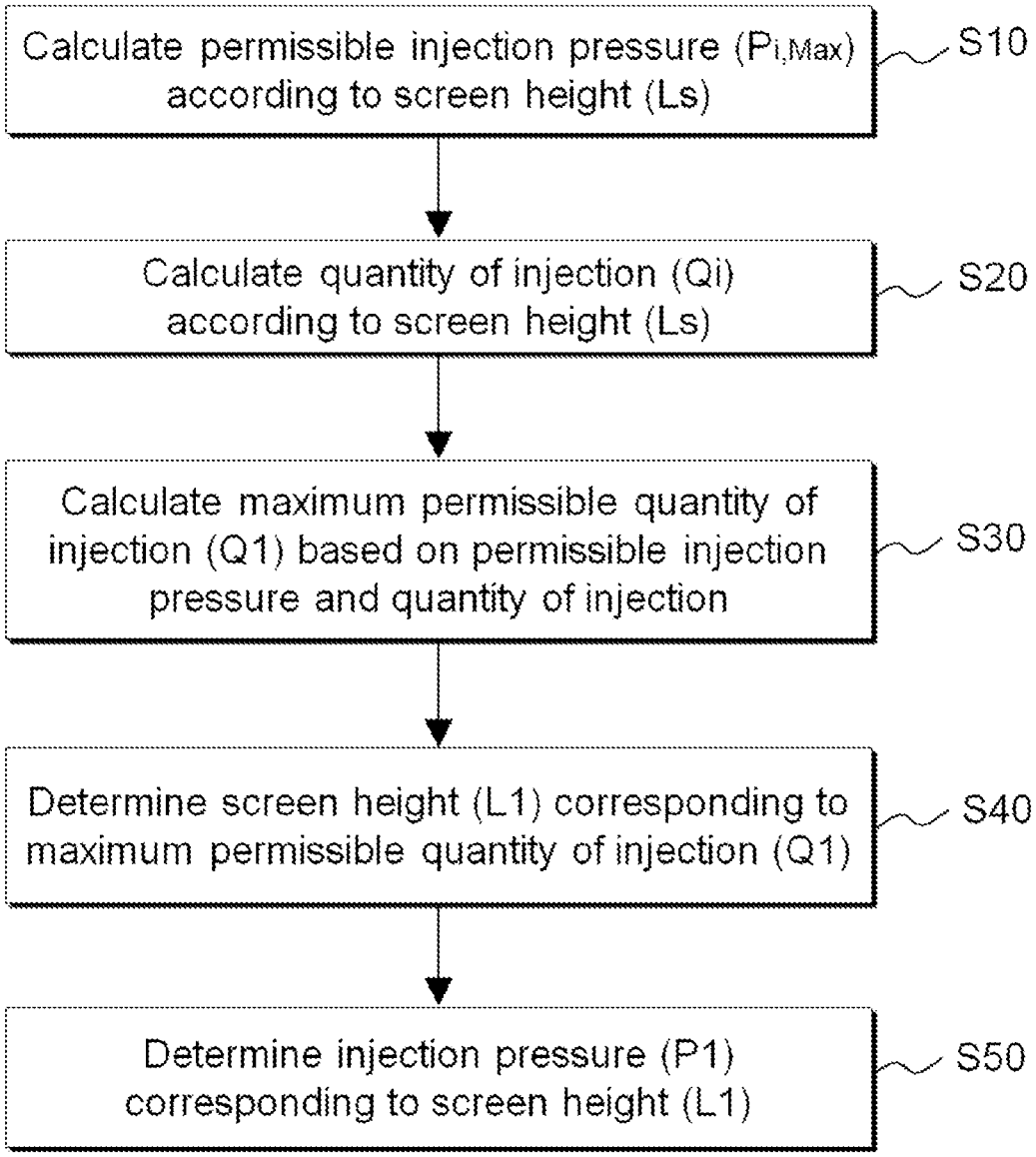
FIG. 5 is a flowchart to explain a method for determining a screen height, an injection pressure, and a quantity of injection which are optimized for artificial recharge according to an embodiment.

FIG. 5 is a flowchart illustrating a method of determining a screen height, an injection pressure, and a quantity of injection which are optimized for artificial recharge according to an embodiment. At step S10, a permissible injection pressure $P_{i,Max}$ according to a screen height Ls is calculated with respect to a region (hereinafter, simply referred to as a "region of interest") where the injection well 40 is to be really installed. That is, a maximum injection pressure that does not cause a crack in the aquiclude 20 at each screen height according to a change in the screen height Ls is calculated.

In this case, it is assumed that a position of the lowermost end 45*b* of the screen 45 is fixed adjacent to a lowermost area of the aquifer 30, and the height of the uppermost end 45*a* of the screen varies according to the screen height Ls. As explained above with reference to FIG. 3A, as the screen height Ls is higher, fresh water is injected closer to the aquiclude-aquifer interface, and accordingly, the effect of the injection pressure on the aquiclude-aquifer interface and the overlying aquiclude increases and thus the permissible injection pressure $P_{i,Max}$ should be lower. As the screen height Ls is lower, fresh water is injected farther from the interface and thus the effect of the injection pressure on the interface is relatively small, and accordingly, the permissible injection pressure $P_{i,Max}$ can increase.

In an embodiment, a pressure that causes a crack in the aquiclude 20 is calculated based on characteristics and a depth of the aquiclude, and the characteristics of the aquiclude 20 may include parameters such as a material forming the aquiclude, porosity, permeability, and thickness. In addition, as a method of calculating a permissible injection pressure $P_{i,Max}$ of the injection well to transmit a pressure lower than or equal to the pressure that does not cause a crack, which is determined by the characteristics of the aquiclude 20, to the bottom of the aquifer, a well-known groundwater flow model such as MODFLOW may be used.

Next, a quantity of fresh water injection Qi according to the screen height Ls is calculated with respect to the region of interest at step S20. As described above with reference to FIG. 3B, as the screen height Ls is higher, the quantity of fresh water injection increases since the number of penetrating holes increases, and as the screen height Ls is lower, the quantity of fresh water injection decreases as the number of penetrating holes decreases. In an embodiment, the quantity of fresh water injection Qi according to the screen height Ls may be calculated by using the well-known groundwater flow model, based on characteristics of the aquifer 30 of the region of interest, that is, parameters such as a material of the aquifer, porosity, permeability, and thickness. The step of calculating the permissible injection pressure $P_{i,Max}$ (S10) and the step of calculating the quantity of injection Qi (S20) may be reversed or may be performed simultaneously.

When the permissible injection pressure $P_{i,Max}$ and the quantity of injection Qi according to the screen height Ls are calculated at steps S10 and S20, a permissible quantity of injection $Q_{i,Max}$ that can be really injected is calculated according to the screen height Ls at step S30. That is, as explained above with reference to FIG. 3C, the quantity of injection $Q_{i,Max}$ according to a certain screen height Ls is calculated based on the permissible injection pressure Pima, and the quantity of injection Qi calculated at steps S10, S20, as shown in the graph of FIG. 3C.

When the graph of FIG. 3C is obtained, a maximum permissible quantity of injection Q1 and a screen height L1 at this time may be determined (step S40), and, when the screen height L1 is determined, a permissible injection pressure $P_{i,Max}$ at the corresponding screen height L1 may be determined according to the graph of FIG. 3A (step S50).

Accordingly, the injection well 40 is made and buried according to the determined screen height L1, and fresh water is injected through the injection well 40 as much as the permissible quantity of injection Q1 under the permissible injection pressure P1, so that artificial recharge can be performed with respect to the corresponding region of interest under optimal conditions.

The above-described method for optimizing artificial recharge may be performed in a certain server or a computer such as a terminal. In an embodiment, the computer may include a processor, a memory, and a storage device. The storage device is a storage medium that semi-permanently stores data like a hard disk driver or a flash memory, and may store a computer program or an algorithm that can perform the method of FIG. 5, and software such as a groundwater flow model.

Various programs or algorithms may be stored in the storage device and may be loaded onto the memory under control of the processor. Alternatively, some programs or algorithms may exist in a separate server or storage device installed outside the computer, and, when data or variables are transmitted from the computer to the corresponding external server or device, the external server or device may execute some steps of the program or algorithm and then may transmit resulting data to the computer.

While the present disclosure has been shown and described with reference to certain preferred embodiments thereof, it will be understood by those skilled in the art that various changes in form and details may be made therein without departing from the spirit and scope of the present disclosure as defined by the appended claims. Therefore, the scope of the present disclosure is defined not by the detailed descriptions of the present disclosure but by the appended claims, and all differences within the scope will be construed as being included in the present disclosure.

EXPLANATION OF SIGNS

10: topsoil layer
20: aquiclude
30: confined aquifer
40: injection well
45: screen

What is claimed is:

1. A method for determining a condition for artificial recharge by using a computer in an artificial recharge system provided with an injection well for injecting fresh water into an aquifer, the method comprising:

a step of calculating a maximum permissible quantity of injection of fresh water to be injected into the aquifer;

a step of determining a height of a screen which is an area on a side surface of the injection well where penetrating holes are formed, based on the calculated maximum permissible quantity of injection; and a step of determining an injection pressure of the fresh water to be injected into the aquifer, based on the height of the screen, wherein the screen is formed as high as the height from a lower end of the injection well.

2. The method of claim 1, wherein the step of calculating the maximum permissible quantity of injection comprises:

a step of calculating a permissible injection pressure according to a certain screen height;

a step of calculating a quantity of injection according to the certain screen height; and a step of calculating a permissible quantity of injection according to the certain screen height, based on a relationship between the calculated permissible injection pressure and the calculated quantity of injection.

3. The method of claim 2, where the step of calculating the permissible injection pressure comprises calculating the permissible injection pressure based on a characteristic of an aquiclude overlying the aquifer.

4. The method of claim 2, wherein the step of calculating the quantity of injection comprises calculating the quantity of injection based on a characteristic of the aquifer.

5. The method of claim 2, wherein the step of determining the height of the screen comprises determining, as the maximum permissible quantity of injection, a permissible quantity of injection having a maximum value in the relationship of the permissible quantity of injection according to the certain screen height, and determining a screen height at this time as the height of the screen.

6. The method of claim 5, wherein the step of determining the injection pressure comprises determining, as the injection pressure, a permissible injection pressure corresponding to the height of the screen in the relationship of the permissible injection pressure according to the certain screen height.

7. A computer-readable recording medium having a computer program recorded thereon to execute in a computer a method for determining a condition for artificial recharge in an artificial recharge system provided with an injection well for injecting fresh water into an aquifer, the computer program executable by a processor in the computer to cause the processor:

to calculate a maximum permissible quantity of injection of fresh water to be injected into the aquifer;

to determine a height of a screen which is an area on a side surface of the injection well where penetrating holes are formed, based on the calculated maximum permissible quantity of injection; and to determine an injection pressure of fresh water to be injected into the aquifer, based on the height of the screen.

* * * * *